US006394579B1

(12) United States Patent
Boyd et al.

(10) Patent No.: US 6,394,579 B1
(45) Date of Patent: May 28, 2002

(54) FLUID EJECTING DEVICE WITH VARIED NOZZLE SPACING

(75) Inventors: Melissa D. Boyd; Mark E. Gorzynski; Timothy E. Beerling; Evan P. Smouse, all of Corvallis, OR (US); Kenneth R Williams, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/379,946

(22) Filed: Aug. 24, 1999

(51) Int. Cl.[7] ..... B41J 2/14
(52) U.S. Cl. ..... 347/47; 347/44; 347/43
(58) Field of Search ..... 347/40, 43, 45, 347/47, 15, 44

(56) References Cited

U.S. PATENT DOCUMENTS

| | | | | |
|---|---|---|---|---|
| 3,852,563 A | | 12/1974 | Bohorquez et al. | 219/216 |
| 4,215,350 A | * | 7/1980 | Mielke et al. | 347/40 |
| 4,812,859 A | | 3/1989 | Chan et al. | 346/140 R |
| 4,963,897 A | | 10/1990 | Kattner | 346/140 R |
| 5,075,689 A | | 12/1991 | Hoisington et al. | 346/1.1 |
| 5,103,246 A | | 4/1992 | Dunn | 346/140 R |
| 5,598,191 A | | 1/1997 | Kneezel | 347/40 |
| 5,635,968 A | | 6/1997 | Bhaskar et al. | 347/59 |
| 5,764,254 A | | 6/1998 | Nicoloff, Jr. et al. | 347/43 |
| 6,145,961 A | * | 11/2000 | Otsuki | 347/43 |

FOREIGN PATENT DOCUMENTS

| | | | |
|---|---|---|---|
| EP | 0481829 A2 | 4/1992 | B41J/13/00 |

* cited by examiner

*Primary Examiner*—John Barlow
*Assistant Examiner*—Manish S. Shah

(57) ABSTRACT

A fluid ejecting device with a body defining an array of nozzles. The nozzles are arranged in an array along an array axis. The array has a first portion in which the nozzles are spaced apart along the array axis by a first pitch, and a second portion in which the nozzles are spaced apart by a different second pitch. The array may have a third portion between the first and second portions with a third pitch different from the first and second pitch. An assembly may include two or more of such fluid ejection devices, and the second portion of one print head may be aligned with the first portion of the other print head. Printers incorporating the fluid ejection devices and printing methods are also disclosed.

18 Claims, 4 Drawing Sheets

FIG. 3
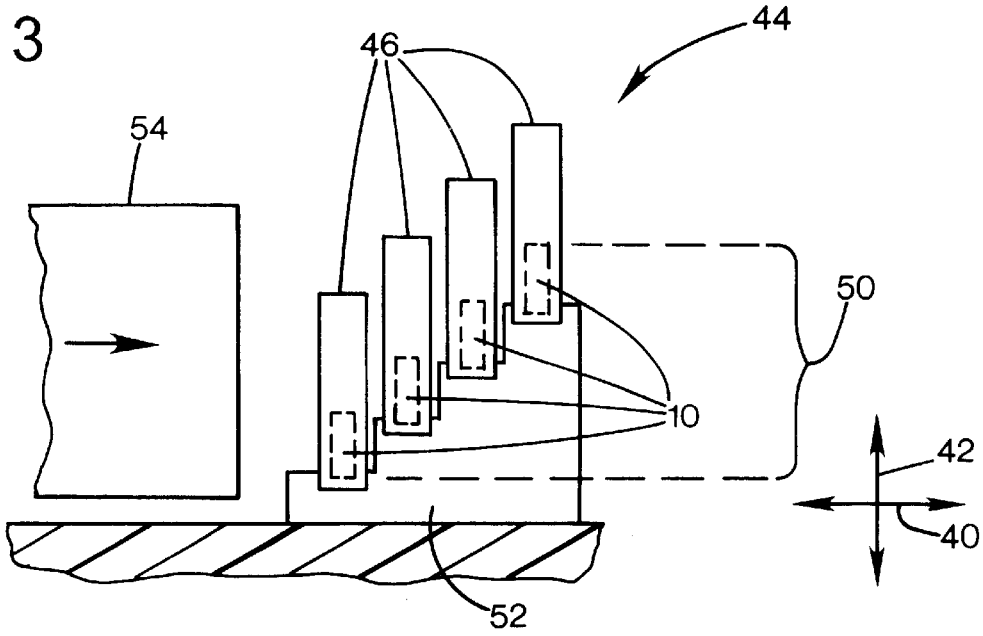
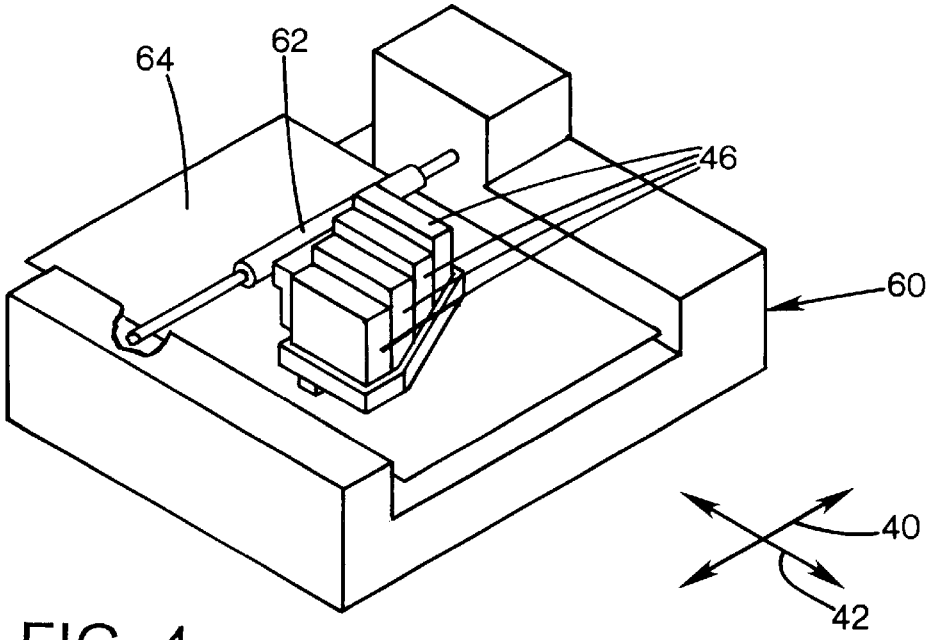
FIG. 4

FLUID EJECTING DEVICE WITH VARIED NOZZLE SPACING

FIELD OF THE INVENTION

This invention relates to fluid ejection devices.

BACKGROUND OF THE INVENTION

Ink jet printers employ pens having print heads that reciprocate relative to a media sheet and expel droplets through an array of nozzles onto the sheet to generate a printed image or pattern. The print heads have arrays of small orifices through which ink is expelled to generate a swath of a printed image.

Two important measures of printer performance are speed and print quality, which typically trade off with each other so that maximizing one compromises the other. The print speed is primarily limited by the scan velocity and by the length of the nozzle array (i.e. the width of a single printed swath). The print quality is primarily limited by the resolution or spacing of nozzles on the print head. For a given array length, the print quality may be maximized by printing multiple overlapping swaths to multiply the array's resolution, with the droplets of each swath filling the spaces between the droplets of other swaths. To maximize print speed, single passes are used.

Developments have led to higher resolution print heads that improve print quality without a speed compromise. However, these developments are limited by physical constraints on the miniaturization of print head components. To provide additional improvements in performance, larger print heads having longer arrays may be used. However, as print heads are made larger, they become more expensive. Beyond the proportional cost per unit area of semiconductor material, larger print head chips result in greater wafer edge losses, and other costs associated with larger chips. For instance, a single defect on a wafer ruins a larger percentage of that wafer's chips.

To avoid the costs associated with larger chips, a multiple chip print head may be employed, either with two or more print head chips of moderate size arranged on a common substrate, or with separate print heads installed in a printer. Such print heads are installed with their nozzle arrays parallel, and offset from each other along the media feed axis to cover adjacent swaths to generate a larger swath.

Such arrangements suffer from an alignment problem that can create a visible artifact where the adjacent swaths join each other at a seam. With high resolution print heads, a small misalignment at the limits of manufacturing capability can be several times the nozzle pitch, or at least a major fraction of the nozzle pitch. When separately replaceable print heads are used, the misalignment can be even greater. Electronic measures may permit correction of multiple-nozzle errors by slightly overlapping the swaths, and disabling the extra overlapping nozzles. However, this technique must tolerate an alignment error of up to one-half the nozzle pitch, leading to a possible gap or overlap of that amount. Such errors are visible as a light or dark band on the printed page.

SUMMARY OF THE INVENTION

Accordingly, the present invention provides a fluid ejection device with a body defining an array of nozzles. The nozzles are preferably arranged in an array along an array axis. The array has a first portion in which the nozzles are spaced apart along the array axis by a first pitch, and a second portion in which the nozzles are spaced apart by a different second pitch. In one embodiment, the first and second portions may be configured of approximately the same size. In another embodiment, the array may have a third portion between the first and second portions with a third pitch different from the first and second pitch.

An assembly may include two or more of such fluid ejecting devices or print heads. The second portion of one print head may be aligned with the first portion of the other print head. Such an assembly may be operated by determining an aligned pair of nozzles, and disabling the nozzles extending beyond each member of the pair and disabling one of the pair.

The present invention also includes printers that incorporate these types of fluid ejection devices and related methods of operating such a printer.

BRIEF DESCRIPTION OF THE DRAWINGS

FIG. 3 is a simplified view of a printer according to an alternative embodiment of the invention.

FIG. 4 is a simplified view of a printer according to another alternative embodiment of the invention.

DETAILED DESCRIPTION OF A PREFERRED EMBODIMENT

Figure 1:
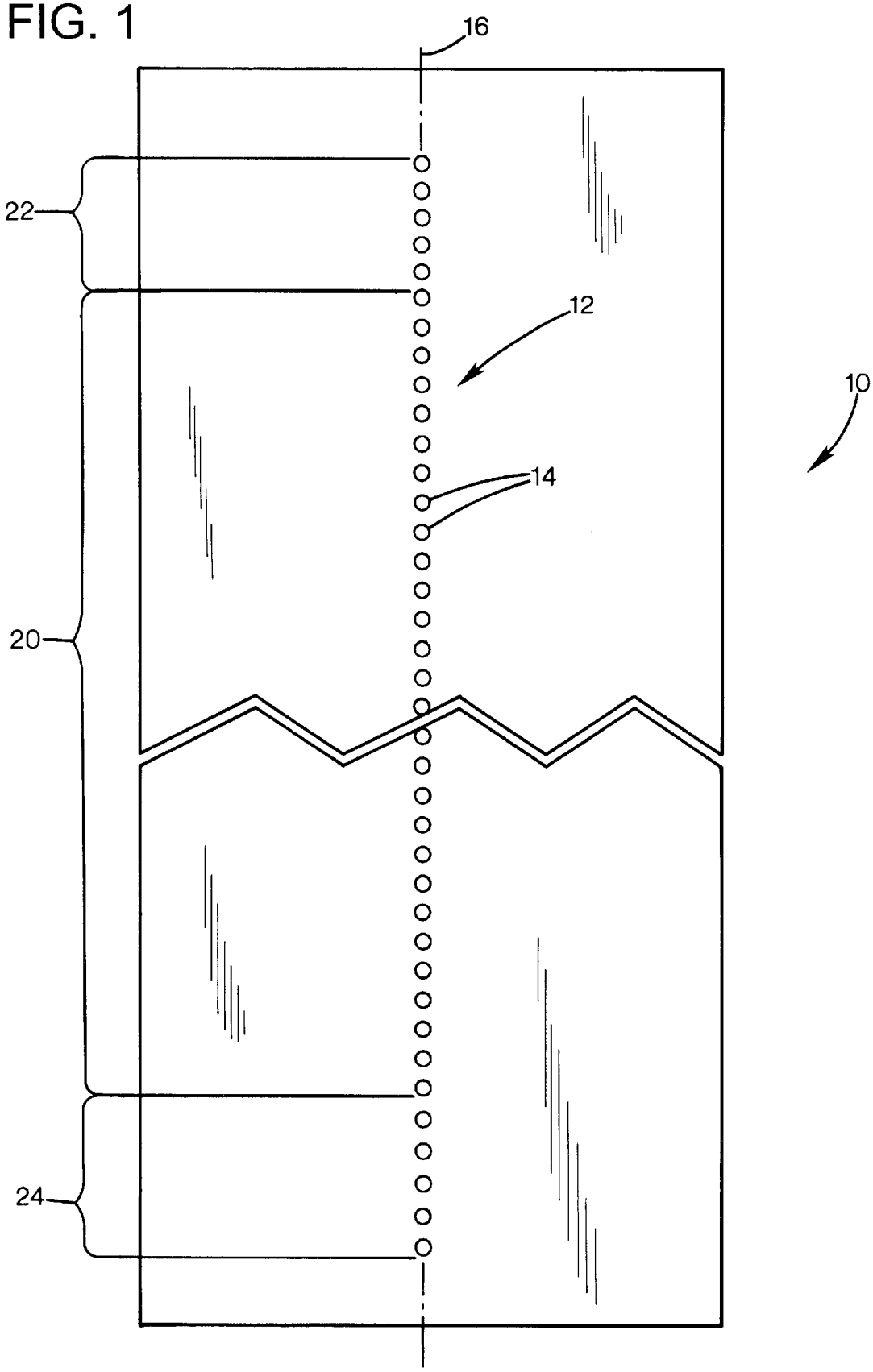
FIG. 1 is an enlarged plan view of a ink jet print head die according to a preferred embodiment of the invention.

FIG. 1 shows an elongated rectangular ink jet print head die 10 defining a linear array 12 of nozzles or orifices 14 extending nearly the length of the chip, and oriented on an array axis 16. The array has a first central portion 20 in which the nozzles are evenly spaced apart along the array axis with a first pitch. A second end portion 22 of the array is contiguous with one end of the central portion, is oriented on the array axis, and includes several nozzles spaced apart at a second pitch incrementally smaller than the first pitch. A third end portion 22 of the array is contiguous with the opposite end of the central portion, is oriented on the array axis, and includes several nozzles spaced apart at a third pitch incrementally larger than the first pitch. Together, the end portions comprise a vernier system.

With a nozzle pitch or spacing period of t, and a total of N nozzles populating the end portions, the endmost N/2 nozzles at one end are spaced at a pitch of $t(1+1/N)$, and the endmost N/2 nozzles at the other end are spaced at a pitch of $t(1-1/N)$. For example, with a pitch of 1/1200 inch, and a 10-nozzle vernier system, the pitch of the five nozzles of the second portion 22 is (0.9/1200) inch, and the pitch of the five nozzles of the third portion 24 is (1.1/1200) inch.

As will be shown below, an arrangement of two such print head dies with overlapping end portions can provide a maximum apparent alignment error limited to $t(1/N)$, so that a seam between swaths printed by the two dies will be essentially undetectable. The total alignment error that may be thus corrected or compensated for is limited to the number of vernier nozzles times the amount by which their pitch varies from the nominal pitch. In this instance, the number of nozzles N and the pitch variance (1/N) are selected to provide a tolerated range of one full dot pitch. Within this range (which may be stated as $+/-t/2$ from a nominally aligned position) the maximum alignment error is limited as noted above, and as will be illustrated below. For systems in which wider alignment errors are expected, the total number of nozzles populating the end section or sections need not be increased, as these sections can overlap effectively with the nozzles of the central portion for the same vernier effect. Of course, for greater nominal overlap to accommodate large alignment variances, slightly longer arrays are needed to provide a given final printed swath width. For systems in which less apparent alignment error is tolerable, a smaller pitch variance and proportionately more nozzles are used.

The illustrated embodiment shows a single linear array of nozzles for simplicity and clarity. In preferred practice, to provide a fine resolution, the nozzles of a single array are arranged in an alternating pattern of two parallel rows, with the odd nozzles in one row, and the even nozzles in the other, so that each row is closely spaced, and a doubled resolution is provided. For the purposes of this application, this arrangement of two or more such rows, or any other arrangement of nozzles along a print head intended to generate a swath of printed droplets, is considered as a single linear array.

Figure 2:
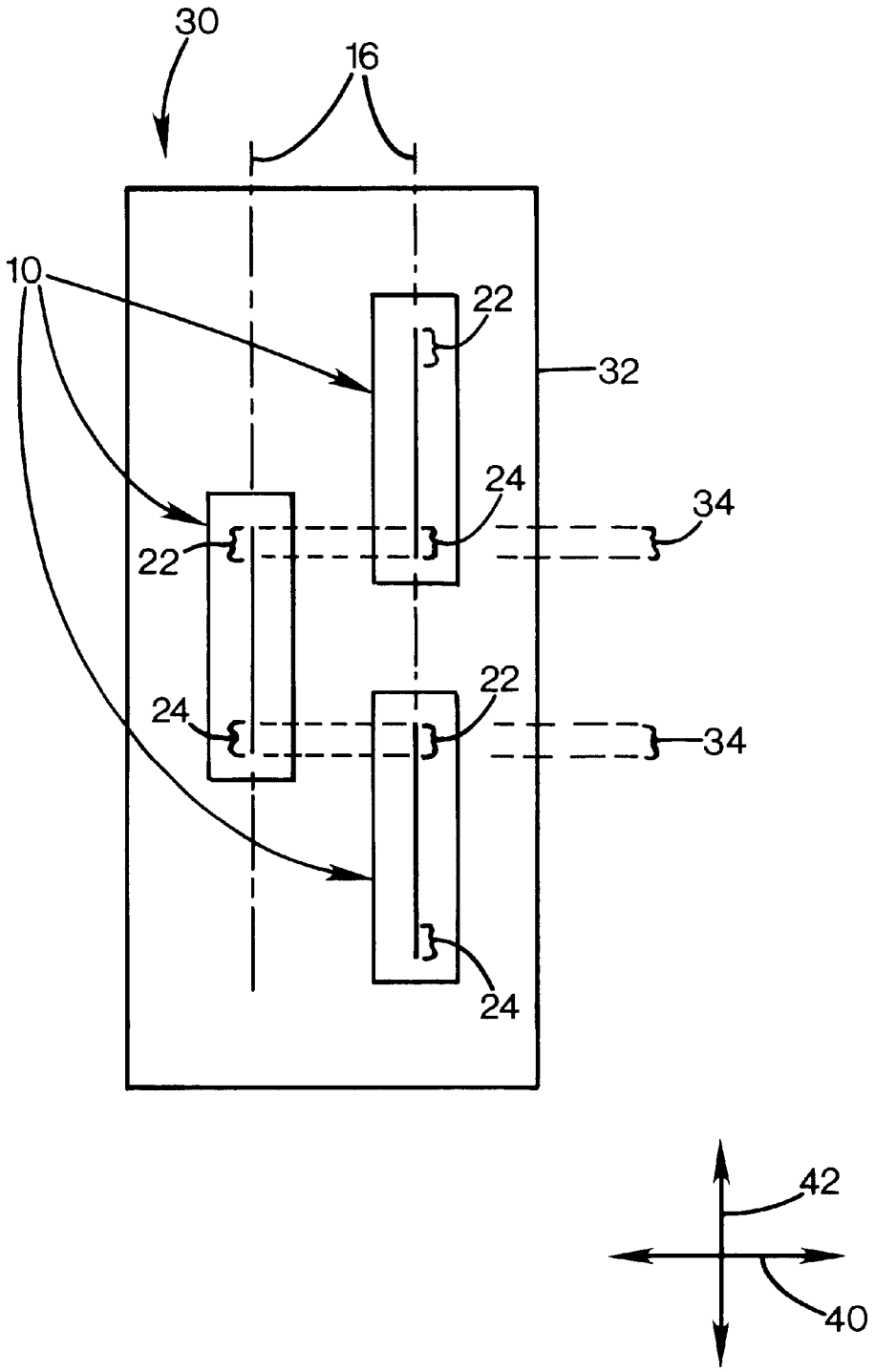
FIG. 2 is an enlarged plan view of a ink jet print head assembly according to the embodiment of FIG. 1.

FIG. 2 shows a print head assembly 30 including three print head dies 10 arranged to generate a seamless swath of printing. In alternative embodiments, any number of dies from two or more may be used to provide a printed swath of any selected width. The dies 10 are arranged with their array axes 16 parallel. They are positioned in a common plane, mounted to a substrate 32, so that the end portion of one overlaps or is registered laterally with the end portion of the adjacent die in an overlap region 34. The assembly is oriented with the array axes 16 perpendicular to a scan axis 40 and parallel to a media feed axis 42, with the scan axis representing the path of motion of a reciprocating carriage in an ink jet printer as swaths are printed, and the feed axis representing the direction along which printed media is advanced for printing of subsequent swaths. In an alternative embodiment, the assembly may be used in a printer in a fixed position, with media advancing along axis 40 for complete printing. This is suitable for rapid printing, such as of items passing on an assembly line, or postal envelopes to be addressed with a limited swath width. An assembly having a greater number of dies may be used to create swath widths capable of printing a page of unlimited width in a single swath, for extremely rapid printing throughput rates. The effective swath width of the assembly is slightly less than the sum total of all the individual arrays due to the overlapping end portions. Nominally, that sum is reduced by the overlap length 34 multiplied by the number of dies minus one.

As shown in FIGS. 3 and 4, a printer using multiple dies for a large swath width need not have the dies mounted on a single unit. FIG. 3 shows a printer 44 having four separately replaceable print cartridges 46, each having one of the dies 10. The cartridges are positioned in a stepped arrangement to generate registration and overlapping of the end portions of each nozzle array with an end portion of each adjacent die. This generates a swath width 50. The cartridges are mounted in a fixed position to a base 52. A media sheet or other printable object 54 is advanced past the print heads along axis 40, which is perpendicular to the array axes. The process of compensating for any slight misalignments among print heads, both initially and after any print heads are replaced, will be discussed below.

FIG. 4 shows an ink jet printer 60 having several staggered print cartridges 46 installed in a carriage 62 that reciprocates along the scan axis 42. A media sheet 64 is advanced along the feed axis following printing of each swath. The feed amount may be as great as the width of the swath for fastest printing, or may be a selected fraction of the swath width for optimum print quality printing using overlapping shingles. A printer having a carriage with multiple receptacles for the staggered print cartridge may also receive different colored cartridges for full color printing, albeit without the advantages of the increased swath width provided by several cartridges of the same color, typically black, and without enjoying the vernier alignment capabilities during color printing. Other alternatives may include assemblies for large swath printing of multiple colors, which simply use a multiple die array or each of several different colors, all on the same assembly, or each color having its own multi-die wide-swath assembly on a separate cartridge. A set of multi-color dies may be used in the same manner as illustrated. Each die would have an array of each color, with each color array having vernier end portions aligning with comparable portions of the same color array on the next die.

Figure 5C:
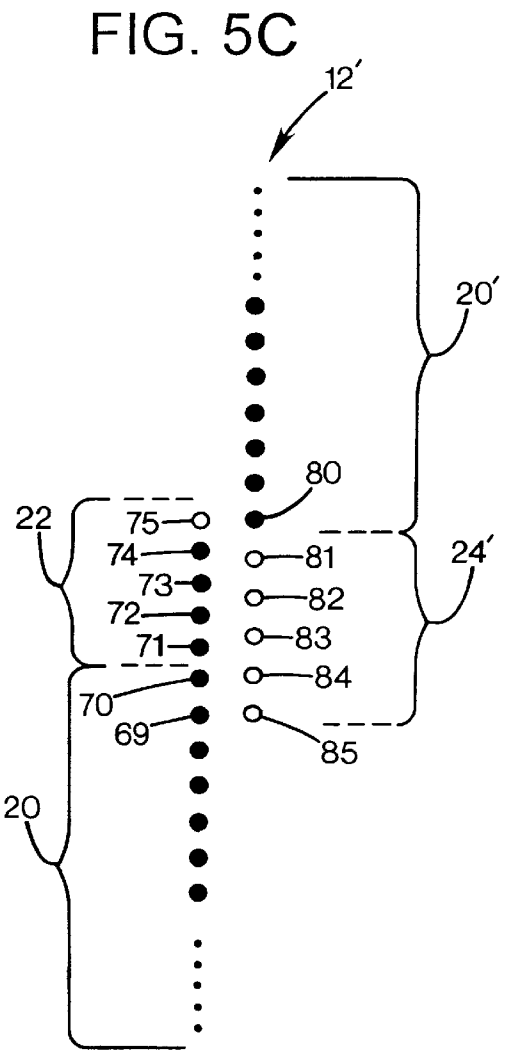
FIGS. 5A, 5B, and 5C illustrate printing operation according to a preferred embodiment of the invention.
Figure 5B:
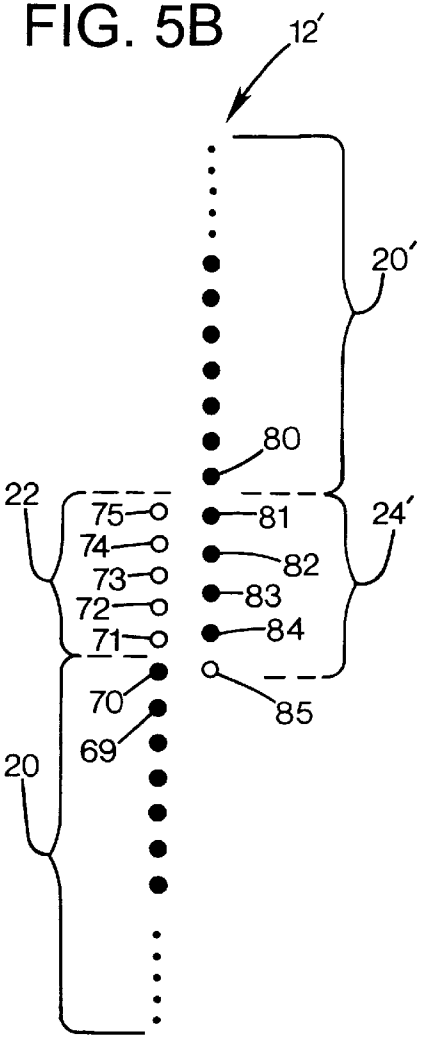
Figure 5A:
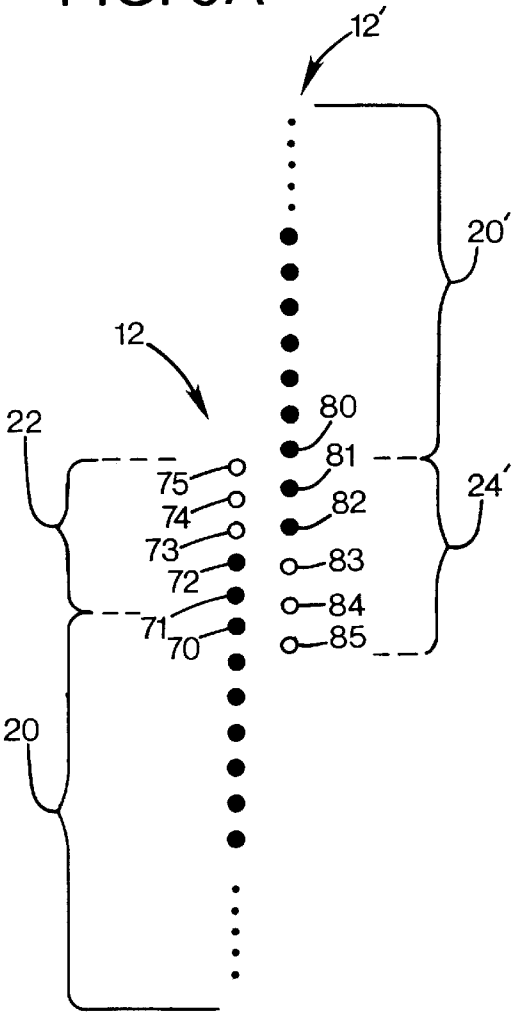

FIGS. 5A, 5B, and 5C schematically illustrate the operation of a printing system using at least two print heads. These figures represent simplified test patterns that may be used to provide aligned printing. The illustrations show which nozzles arc operated in the overlapping end portions of the adjacent print heads, at three different variations in registration between the two print heads. This illustrates the transition or seaming between the swath portion printed by one array, and the portion printed by the adjacent array.

In FIG. 5A, a first nozzle array 12 has an end portion 22 that is laterally registered with the end portion 24' of a second array 12'. In this example, each end portion has five nozzles, with portion 22 spaced at 90% of the standard pitch, and end portion 24 spaced at 110% of the standard pitch. In this example, the second array 12' is nominally registered with the first, in that it is at the middle of the tolerance range in which the vernier system can maintain the tight tolerance (t/N) on spacing between the last dot row printed by one array, and the first dot row printed by the next array.

The system operates in the manner of a vernier, with the different nozzle pitches providing one (or two adjacent) nozzles of one end portion approximately aligned with a nozzle (or pair) from the corresponding end portion of the other array. In this instance, nozzle 73 is best aligned with nozzle 82. The break point between swaths is selected to be at this aligned pair. This means that the nozzles of each end portion beyond the members of the aligned pair 73, 82 are to be disabled, with nozzles 74, 75, 83, 84, and 85 being disabled, preventing double printing overlap. One of the aligned pair also must be disabled to prevent double printing of a single dot row.

If the aligned pair is perfectly aligned, it does not matter which is disabled. However, in most instances such as this, the pair is slightly misaligned. When this occurs, a nozzle is disabled to ensure that one array is terminated by a member of the best aligned pair, and the other is terminated by a member of a second best aligned pair. The nozzles that are disabled are indicated by open circles, and the nozzles that are enabled, by solid circles. In this case, it is apparent that the misalignment is in a direction such that pair 72–83 is the second best aligned pair, with pair 74–81 being less well aligned. Thus, selection of which of the aligned pairs to disable is based on which one is a member of the array that contains a still enabled member of the second best aligned pair. Here, nozzle 72 of array 12 remains enabled, as it is positioned between the best aligned pair member 73 and the central portion 20 of the array. Second best aligned pair member 83, however, is already disabled, as it is beyond the best aligned member 82. Thus, nozzle 73 is disabled, so that array 12 is to terminated by an operable nozzle of the second best aligned pair, and array 12' is terminated by a member of the best aligned pair.

FIG. 5B illustrates the same system, but with the array 12' shifted upward for a reduced overlap condition. This approximates nearly the limit at which the ability to maintain limited seam alignment errors is compromised. In this instance, nozzle 70 appears well aligned with nozzle 85. Thus either may be disabled. However, it is preferable to disable a remote or end nozzle such as 85, instead of a member of the center array portion. It is believed that nozzles nearer the end of an array may have a slightly higher failure rate, so that some nominal reliability advantage may be gained with this preference. Accordingly, along with nozzles 71–75, nozzle 85 is disabled. This rule may also be applied in other instances where there is an equal choice between two well aligned nozzles, not just a choice involving an end nozzle. Note that if the array 12' were shifted upward enough to slightly misalign the pair 70–85 (i.e. by up to 1/10 of a nozzle pitch), nozzle 85 would remain enabled, and nozzle 70 disabled, as nozzle 96 and imaginary nozzle 86 (not shown) would be a second best aligned pair.

FIG. 5C illustrates a greater overlap condition, in which pair 75–80 is best aligned, and nozzle 75 disabled on the principle of disabling a remote nozzle when alignment is ideal. As above, a slightly more extreme misalignment between the arrays (by moving array 12' downward by a small fraction of a nozzle pitch) would necessitate the disabling of nozzle 75 instead, under the higher order rule that the array with a disabled best-aligned nozzle shall have its second best aligned nozzle as the terminal enabled nozzle. As noted above, the system can tolerate any amount of overlap while maintaining the accurate alignment at the seam, due to the ability for either of the end portions to operate as a vernier against the central portion of the next array.

The process of determining which nozzles are aligned depends on the application. After manufacture of a print head assembly 30 as in FIG. 2, the assembled unit can be inspected to determine alignment and disabling choices. This may be undertaken by an automated system using microscopic machine vision, which transmits disablement data to control circuitry (not shown) on the die, assembly, printer, or connected computer. Another means of determining alignment is to print a test pattern, which may selectively print lines to aid a visual or machine detected alignment. Such printed patterns may also employ moiré patterns to aid the recognition of fine misalignments. These may also be used in systems in which the print heads are separately replaceable in the field. In these cases, a user or service technician runs an alignment test, typically with the aid of alignment software in a computer connected to the printer in which the print heads are installed. The software prints patterns, and inquires as to which of selected samples exhibits a visual characteristic associated with alignment. The user enters the preference, and the computer then instructs the printer control circuitry to disable appropriate nozzles. Similarly, a sensor in the printer may automatically scan an alignment pattern, and transmit alignment information to the control circuitry without user involvement or the opportunity for operator error.

While the above is discussed in terms of preferred and alternative embodiments, the invention is not intended to be so limited. For instance, the number of end portion nozzles and pitch differences can vary widely depending on the sensitivity to misalignment. In an alternative embodiment, a spacing variation need be provided at only one end of the array. This would operate as a vernier against the standard spacing. The equivalent of the illustrated example might be provided by five nozzles at one end, with 120% or 80% of the standard spacing, to provide the t/10 accuracy. However, this may make the end portion more noticeably dense or light in appearance in the printed result. In this case, as in the preferred embodiment, such density variations are compensated for by designing the print head to emit proportionately larger droplets from more widely spaced end portion nozzles, and proportionately smaller droplets from densified end portions, generating comparable visual print density.

The illustrated system may also be employed as a single print head, with the varied spacing end portions used to provide better seaming between sequentially-printed swaths. A printer design with a media advance amount that varies from printer to printer, but which is precisely repeated within each printer, is a suitable application. Each printer's advance amount may be measured, and the selection of which end portion nozzles made to ensure accurate seaming between swaths, using the techniques of the preferred embodiment.

What is claimed is:

1. A fluid ejection device comprising:

a body defining an array of nozzles;

the nozzles being arranged in an array along an array axis;

the array having a first portion in which the nozzles are spaced apart along the array axis by a first pitch;

the array having a second portion in which the nozzles are spaced apart by a different second pitch; and a third portion having a third pitch different from the first pitch and the second pitch.

2. The device of claim 1 wherein the third pitch is between the first and second pitches.

3. The device of claim 1 wherein the third portion occupies an intermediate portion of the array.

4. The device of claim 1 wherein the third portion comprises a major portion of the array.

5. A fluid ejection device comprising:

a body defining an array of nozzles;

the nozzles being arranged in an array along an array axis;

the array having a first portion in which the nozzles are spaced apart along the array axis by a first pitch; and the array having a second portion in which the nozzles are spaced apart by a different second pitch;

wherein the first and second portions have approximately the same length.

6. The device of claim 5 wherein the first and second portions include nozzles at opposed ends of the array.

7. The device of claim 1 wherein the difference between the second pitch and the first pitch, multiplied by the number of nozzles occupying the first and second portions, is at least as great as the lesser of the nozzle pitches.

8. An ink jet printer comprising:

first and second ink jet print heads;

each print head defining an array of nozzles;

the nozzles of each print head being arranged in an array parallel to an array axis;

each array having a first portion in which the nozzles are spaced apart along the array axis by a first pitch; and each array having a second portion in which the nozzles are spaced apart by a second pitch different from the first pitch;

wherein each array includes a third portion have nozzles at a third pitch different from the first and second pitches.

9. The printer of claim 8 wherein the first portion of each array includes nozzles positioned at a first end of the array, and the second portion of each array includes nozzles positioned at an opposed second end of the array.

10. The printer of claim 8 wherein the end portion of the first print head and the end portion of the second print head are registered with each other along a common portion of the array axis.

11. An ink jet printer comprising:

first and second ink jet print heads;

each print head defining an array of nozzles;

the nozzles of each print head being arranged in an array parallel to an array axis;

each array having a first portion in which the nozzles are spaced apart along the array axis by a first pitch; and each array having a second portion in which the nozzles are spaced apart by a second pitch different from the first pitch;

wherein the second pitch is greater than the first pitch and a third pitch is less than the first pitch.

12. The printer of claim 11 wherein the second and third pitches each differ from the first pitch by a common amount.

13. The printer of claim 11 wherein the difference between the second pitch and the first pitch is inversely proportional to the number of nozzles in at least one of the end portions.

14. A method of operating an ink jet printer comprising the steps:

providing at least a first print head and a second print head, each defining an array of apertures parallel to a common array axis, the arrays each having an overlapping portion and a major portion, the overlapping portions registered with each other, the major portions of each array extending away from the associated overlapping portion, the overlapping portions each having a different nozzle pitch;

determining a best aligned pair of nozzles, one nozzle of the pair selected from the overlapping portions of each of the arrays;

for each overlapping portion, disabling the nozzles of an extending portion extending away from the major portion beyond the nozzle of the aligned pair; and disabling one of the nozzles of the aligned pair.

15. The method of claim 14 including operating the printer to print using the remaining nozzles other than the disabled nozzles.

16. The method of claim 14 wherein determining a best aligned pair of nozzles includes printing a test pattern.

17. The method of claim 14 including operating the printer to emit a different drop volume through at least some of the nozzles of at least one of the overlapping portion from the drop volume emitted through the nozzles of the major portions.

18. The method of claim 14 including operating the printer to emit a drop volume through each nozzle based on the pitch of the portion in which each nozzle resides.

* * * * *